US009416623B2

(12) United States Patent
Renkes et al.

(10) Patent No.: US 9,416,623 B2
(45) Date of Patent: Aug. 16, 2016

(54) PRESSURE DEPENDENT WELLBORE LOCK ACTUATOR MECHANISM

(71) Applicant: HALLIBURTON ENERGY SERVICES, INC., Houston, TX (US)

(72) Inventors: Kevin Michael Renkes, Dallas, TX (US); Scott Luke Miller, Dallas, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/410,233

(22) PCT Filed: Dec. 18, 2013

(86) PCT No.: PCT/US2013/075976
§ 371 (c)(1),
(2) Date: Dec. 22, 2014

(87) PCT Pub. No.: WO2015/094210
PCT Pub. Date: Jun. 25, 2015

(65) Prior Publication Data

US 2015/0376982 A1 Dec. 31, 2015

(51) Int. Cl.

| | |
|---|---|
| ***E21B 23/04*** | (2006.01) |
| ***E21B 34/10*** | (2006.01) |
| ***E21B 34/12*** | (2006.01) |
| ***E21B 41/00*** | (2006.01) |
| *E21B 34/00* | (2006.01) |

(52) U.S. Cl.
CPC ..... *E21B 34/102* (2013.01); *E21B 23/04* (2013.01); *E21B 34/12* (2013.01); *E21B 41/00* (2013.01); *E21B 2034/007* (2013.01)

(58) Field of Classification Search
CPC ..... E21B 23/04; E21B 34/08; E21B 34/10; E21B 34/102; F16B 1/005; F16B 1/0057; F16B 7/105; E05B 51/02; E05B 51/023
See application file for complete search history.

(56) References Cited

U.S. PATENT DOCUMENTS

| | | | | |
|---|---|---|---|---|
| 3,321,217 A * | 5/1967 | Ahlstone | ..... | E21B 33/038 166/338 |
| 3,939,913 A * | 2/1976 | Mott | ..... | E21B 34/102 166/375 |
| 4,083,401 A | 4/1978 | Rankin | | |
| 4,345,648 A | 8/1982 | Kuus | | |
| 4,392,377 A | 7/1983 | Rankin | | |
| 4,479,539 A | 10/1984 | Tamplen et al. | | |

(Continued)

OTHER PUBLICATIONS

International Patent Application No. PCT/US2013/075976 , International Search Report and Written Opinion, mailed Sep. 22, 2014, 9 pages.

*Primary Examiner* — Cathleen Hutchins
(74) *Attorney, Agent, or Firm* — Kilpatrick Townsend & Stockton LLP

(57) ABSTRACT

A tool string having a pressure dependent mandrel and actuator assembly can operate at the annulus pressure within a wellbore to lock the mandrel actuator assembly and prevent further motion of the mandrel within the tool string as the tool string is moved upward or downward in the wellbore. The tool string can further include a valve connected to the actuator assembly, where the valve can be in an open configuration within the wellbore due to the annulus pressure and related motion of the mandrel, and then be locked in an open configuration regardless of the annulus pressure as the tool string is moved upward or downward in the wellbore.

20 Claims, 11 Drawing Sheets

(56) References Cited

U.S. PATENT DOCUMENTS

| | | | | |
|---|---|---|---|---|
| 4,566,478 | A * | 1/1986 | Deaton | E21B 21/10 137/112 |
| 4,655,288 | A | 4/1987 | Burris, II et al. | |
| 4,694,903 | A | 9/1987 | Ringgenberg | |
| 4,842,064 | A | 6/1989 | Gazda | |
| 5,058,683 | A | 10/1991 | Godfrey et al. | |
| 5,335,731 | A | 8/1994 | Ringgenberg et al. | |
| 6,408,946 | B1 | 6/2002 | Marshall et al. | |
| 7,503,390 | B2 | 3/2009 | Gomez | |
| 2008/0115944 | A1 | 5/2008 | Coon et al. | |
| 2009/0025923 | A1 * | 1/2009 | Patel | E21B 43/045 166/51 |
| 2012/0085542 | A1 * | 4/2012 | Hayter | E21B 23/04 166/332.4 |

* cited by examiner

PRESSURE DEPENDENT WELLBORE LOCK ACTUATOR MECHANISM

CROSS-REFERENCE TO RELATED APPLICATIONS

This is a U.S. national phase under 35 U.S.C. 371 of International Patent Application No. PCT/US2013/075976, titled "Pressure Dependent Wellbore Lock Actuator Mechanism" and filed Dec. 18, 2013, the entirety of which is incorporated herein by reference.

TECHNICAL FIELD

The present disclosure relates generally to mechanical devices and, more particularly (although not necessarily exclusively), to a pressure dependent actuator mechanism that can be used in a wellbore environment, where the actuator mechanism can, in particular lock a valve in a position.

BACKGROUND

Tool assemblies deployed into a wellbore of a well system (e.g., oil or gas wells for extracting fluids from a subterranean formation) may include multiple components or devices coupled together. Several of such tool assemblies require movement or actuation of specific mechanical parts, and may further require or be optimized by, locking such mechanical parts in a specific position. The movement of mechanical parts within tool assemblies can be subject to, and in some conditions primarily controlled by, the annulus pressure within the wellbore. Such locking of parts or tool assemblies during deployment may be advantageous as the tool assemblies are moved uphole or downhole within a well system and wellbore. Accordingly, there remains a need for actuating mechanical aspects of tool assemblies during deployment in a wellbore without the complexity of controlling such parts at pressures other than the wellbore environment annulus pressure.

DETAILED DESCRIPTION

Figure 1A:
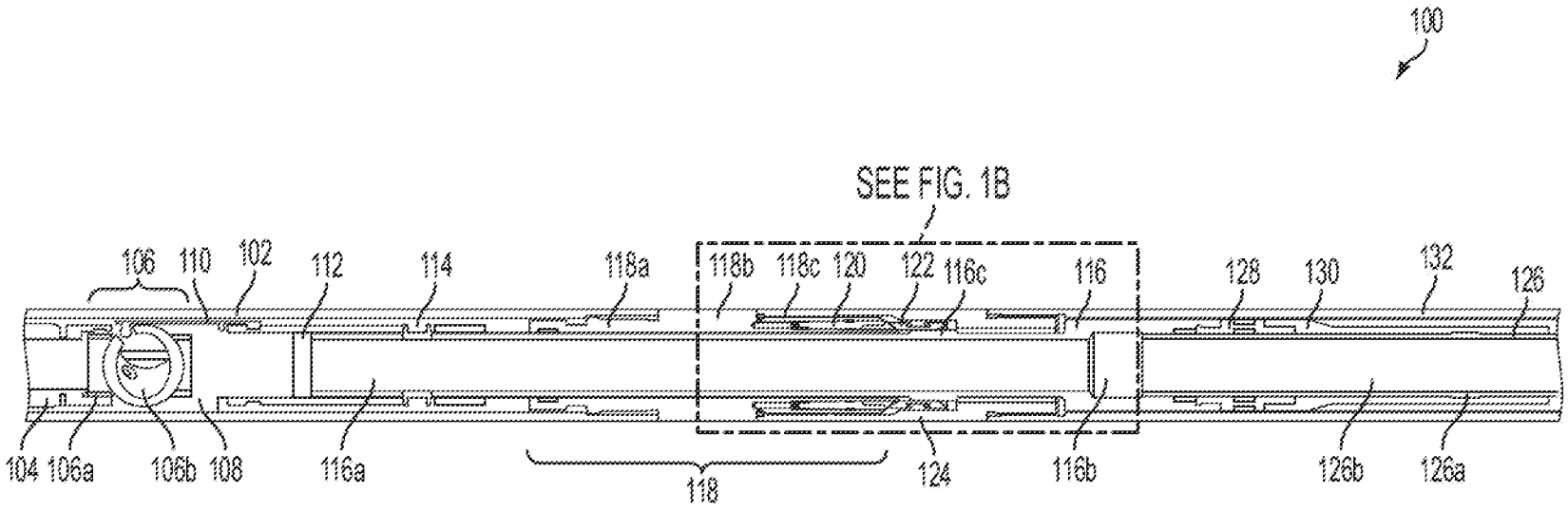
FIG. 1A is a side profile schematic illustration of an example of a pressure dependent actuator, connected to a mandrel in a first position and a valve in a closed position, according to one aspect of the present disclosure.

Throughout this description for the purposes of explanation, numerous specific details are set forth in order to provide a thorough understanding of the many embodiments disclosed herein. It will be apparent, however, to one skilled in the art that the many embodiments may be practiced without some of these specific details. In some instances, well-known structures and devices are shown in diagram or schematic form to avoid obscuring the underlying principles of the described embodiments.

In aspects of the present disclosure, a tool string can be deployed in a wellbore having an actuator that operates under the annulus pressure within the wellbore. In embodiments, the actuator is coupled to a valve on the tool string that can open the tool string to receive to hydrocarbons, water, and other fluids and materials within the wellbore, where the valve similarly operates under the annulus pressure within the wellbore. In such embodiments, neither an actuator nor a valve on the tool string operates under pressure conditions different or separately controlled from the annulus pressure. Once at an operating depth or pressure within the wellbore, a locking mechanism that can include locking pistons and locking dogs can move to a locking position due to the annulus pressure, preventing further movement of the valve and actuator which would close the valve.

These illustrative examples herein are given to introduce the reader to the general subject matter discussed here and are not intended to limit the scope of the disclosed concepts. The following sections describe various additional aspects and examples with reference to the drawings in which like numerals indicate like elements, and directional descriptions are used to describe the illustrative aspects. The following sections use directional descriptions such as "uphole," "downhole," "inward," "outward," etc. in relation to the illustrative aspects as they are depicted in the figures, the uphole direction being toward the surface of the well, the downhole direction being toward the toe of the well, the inward direction being toward the longitudinal axis (or centerline) of the tool string (alternatively referred to as a "tool assembly"), and the outward direction being away from the longitudinal axis of the tool string. Further, portions of structural elements described herein can be referred to by their uphole or downhole ends. Like the illustrative aspects, the numerals and directional descriptions included in the following sections should not be used to limit the present disclosure. Unless otherwise indicated, the convention used by the Figures described herein has the uphole direction oriented to the left side of a Figure and the downhole direction oriented to the right side of a Figure.

Maintaining the mechanical position of parts of a tool assembly during deployment within a wellbore and well system is often dependent on the annulus pressure, i.e. the hydrostatic pressure in the wellbore environment, on the various parts of the tool assembly. Thus, mechanical parts of such tool assemblies may be controlled, held, or locked in a specific position or configuration by controlling the pressure at the particular mechanical part at a different pressure than the surrounding annulus pressure. Moreover, the tool assemblies and parts within tool strings can be moved in uphole and downhole directions by modifying the annulus pressure of a wellbore, which in some embodiments is accomplished by introducing nitrogen gas through the tool assembly. Further, parts within a tool string may be rotated within the tool string, moving from a first position to be rotationally offset toward a second position, which in some embodiments can be accomplished modifying the annulus pressure in at least a section of the tool string. The use of modified pressure to move a tool assembly in a wellbore can further limit the range of pressures in which a separate, pressure dependent, part of the tool assembly can operate. In some applications, the complexity or challenge of locking parts by differential pressure relative to the annulus pressure can be burdensome. In such applications, mechanical parts of such tool assemblies including actuators and valves can be operated without controlling the position or configuration of some mechanical parts, allowing those parts of the tool assembly to be subject to and primarily controlled by the annulus pressures in the wellbore and well system.

A tool string can include a locking mechanism that, in aspects, includes a locking dog and locking piston configuration proximate to a projection extending from the exterior surface of an operating mandrel or a delivery gas mandrel. In embodiments, as the tool string is deployed into a wellbore, the operating mandrel and gas delivery mandrel can shift in a downhole or uphole direction. When the operating mandrel and gas delivery mandrel shift in an uphole direction, projections along the operating mandrel or gas delivery mandrel can urge the locking dog elements laterally away from the centerline of the tool string and toward the exterior of the tool string. In alternative or additional embodiments, the operating mandrel and gas delivery mandrel can be rotated from a first position (or orientation) to a second position (or orientation). When the operating mandrel and gas delivery mandrel is rotationally offset from a first position to a second position, projections along the operating mandrel or gas delivery mandrel can urge the locking dog elements laterally away from the centerline of the tool string and toward the exterior of the tool string. In such embodiments, the locking dog elements are pushed toward an interior cavity encased by the tool string. In aspects, however, if the locking piston elements have extended into the encased interior cavity, then the locking dog elements are blocked from moving into that space, and accordingly cannot be urged by the projections along the operating mandrel or gas delivery mandrel. Thus, in some embodiments, the locking dog elements block and obstruct the projections from moving in the uphole direction, and thereby prevent the operating mandrel and gas delivery mandrel from moving in the uphole direction. Similarly, in some embodiments, the locking dog elements block and obstruct the projections from rotating, and thereby prevent the operating mandrel and gas delivery mandrel from rotating within the tool string.

A tool string that includes an operating mandrel and a gas delivery mandrel can have one or both of the mandrels mechanically coupled and fluidly coupled to each other, and to additional mechanical structures. In embodiments, the gas delivery mandrel delivers nitrogen gas to the tool string and to the wellbore environment. The operating mandrel and gas delivery mandrel can be moved in the uphole direction, downhole direction, or rotated within the tool string, and further can be held and locked in a position or configuration so that the operating mandrel and gas delivery mandrel, and any other structures mechanically connected thereto, will not move relative to their location in the overall tool string. In aspects, one or more collets can mechanically couple with projections on the exterior of operating mandrel or gas delivery mandrel, such that the collets block or obstruct the operating mandrel and gas delivery mandrel from moving relative to their location, or otherwise changing their configuration, within the overall tool string. In aspects, however, the pressure on either the uphole or the downhole side of the operating mandrel and gas delivery mandrel can be sufficient to exert enough force on the mandrel projections such that the collets jump the projections, and the projections shift past the portion of the collects that mechanically couple with the projections.

A tool string can further include a valve, where the valve can move from a closed position to an open position once the tool string has descended past a certain depth in the wellbore. Such valves can be designed to be in an open position when deployed at a specific depth within a wellbore, the depth correlating to a specific pressure or pressure range. The valve, being open at the desired depth or pressure, can collect fluids such as hydrocarbons, water, slurry, other solid materials or combinations thereof. If a valve on a tool string transitions between an open and closed based solely on the depth of tool string deployment and the related annulus pressure in the wellbore, then as the tool string is retracted back uphole toward the well surface, the valve can close with fluid remaining within the interior volume of the tool string. In aspects, a valve can be switched between an open and a closed position by an actuating mechanism, which can similarly move between a first position (or configuration) and a second position (or configuration) based on the related annulus pressure in the wellbore. Fluid that remains within the interior volume of the tool string adds weight to the tool string, requiring more effort to raise the tool string out of the wellbore and risking strain-related damage to the tool string as it is withdrawn in the uphole direction. Conversely, if a valve is maintained in an open position as a tool string is withdrawn in the uphole direction, fluid can drain out of the tool string through the open valve, reducing the weight of the tool string and similarly reducing the effort required and risk of damage when raising the tool string.

As used herein, the term "locking dog" generally refers to a structure of one or more elements that extend lengthwise along cylindrical elements within a wellbore in an arrangement of mechanical locking. The locking dog elements can move from a position toward the exterior of a wellbore to a position toward the interior of a wellbore, where the locking dog can come into contact with a portion of a mandrel or other tool string component. When the locking dog elements are biased toward the interior of a wellbore, in contact with a portion of the mandrel or other pipe component, the locking dog prevents movement of such elements, or any other elements mechanically coupled thereto, in either an uphole or a downhole direction. Similarly, as used herein, the term "slide-locking dog" generally refers to a locking dog structure that is configured to slide along or against a portion of a mandrel or other tool string component between a position toward the exterior of a wellbore to a position toward the interior of a wellbore. In some aspects, the motion of a locking dog structure can be reversible, while in other aspects, the motion of a locking dog structure is not reversible.

FIG. 1A is a side profile schematic illustration of an example of a tool string having a pressure dependent actuator, connected to a mandrel in a first position 100. An operating case 102 can at least in part encase and support a retainer 104, where the uphole side of the retainer 104 is mechanically coupled, directly or indirectly, to machinery or apparatus at the top of the wellbore or well system controlling the tool string. The downhole side of the retainer 104 is mechanically coupled to the uphole side of a ball-and-seat valve 106, which includes a seat 106*a* in which a ball 106*b* is rotatably mounted. Rotation of the ball 106*b* between a first and second position within the seat 106*a* corresponds to the ball-and-seat valve 106 switching between a closed and an open position. As shown in FIG. 1A, the ball-and-seat valve 106 is in a closed position. The downhole side of the ball-and-seat valve 106 is mechanically coupled to the uphole side of a ball cage 108. The ball cage 108 is configured to at least in part encase and support the ball-and-seat valve 106. Similarly, the operating case 102 can at least in part encase and support both the ball-and-seat valve 106 and the ball cage 108. An operating arm 110 has an uphole end proximate to the ball-and-seat valve 106 that is mechanically coupled to the ball 106*b*. When the operating arm 110 is actuated, the operating arm 110 can rotate the ball 106*b* within the seat 106*a* between a first and second position, respectively switching the ball-and-seat valve 106 between the closed and the open positions. When the ball-and-seat valve 106 is in an open position, the interior volumes of the retainer 104, ball-and-seat valve 106, and ball cage 108 are all in fluid communication with each other.

The operating arm 110 has a downhole end proximate to and mechanically coupled to an operating connector 112. The operating connector 112 can be configured to at least partially surround both the ball cage 108 and an operating mandrel 116, such that the interior volumes of the ball cage, operating connector 112, and operating mandrel 116 are all in fluid communication with each other. In aspects, the operating mandrel 116 has a first interior volume 116*a* which is in fluid communication with the interior volume of the ball cage 108, where the diameter of the first interior volume 116*a* being configured to couple and match with the diameter of the interior volume of the ball cage 108 and operating connector 112. In further aspects, the operating mandrel 116 has a second interior volume 116*b* which is in fluid communication with the interior volume of other tool string elements. In yet further aspects, the operating mandrel 116 can have operating mandrel shoulders 116*c* which can be lateral or longitudinal projections extending from the primary exterior surface of the operating mandrel 116, where the operating mandrel shoulders 116*c* increase the exterior diameter of the operating mandrel 116 along the length of the operating mandrel shoulders 116*c*. The operating connector 112 can be further configured to mechanically couple with the operating mandrel 116 and be held at a specific position along the exterior of the operating mandrel 116 by being mechanically coupled with locking dogs 114. The motion of the operating mandrel 116 can be between a first mandrel position and second mandrel position. In some aspects, the first and second mandrel positions can be a relatively downhole and a relatively uphole position, respectively, within the tool string. Conversely, in some aspects, the first and second mandrel positions can be a relatively uphole and a relatively downhole position, respectively, within the tool string. In other aspects, the first and second mandrel positions can be configurations of the operating mandrel 116 at least partially rotated about the centerline of the tool string, that are rotationally offset from each other. In all aspects, the operating mandrel 116 can move to, and optionally function at, intermediary or modified positions between the first mandrel position and the second mandrel position.

The locking dogs 114 are initially in a first position that is biased toward the exterior of the operating case 102 relative to the centerline of the tool string. In embodiments, as the tool string is being deployed to its operating depth, the locking dogs 114 can be connected to one or both of either the operating case 102 and the operating connector 112, but is not in contact with the operating mandrel 116. When the locking dogs 114 are in their first position, the operating connector 112 and operating mandrel 116 can move independently of each other and are not mechanically coupled so as to translate motion from one element to the other. The locking dogs 114 can be configured to shift to a second position, biased toward the interior of the tool string, in contact with both the operating connector 112 and the operating mandrel 116, coupling the operating connector 112 and the operating mandrel 116 to each other. In aspects, the locking dogs 114 shift or fall inward and couple the operating connector 112 to the operating mandrel 116 when the operating arm 110 is actuated for the first time. In some aspects, the locking dogs 114 are shifted to their second, interior position one the tool string has reached its operating depth in a wellbore. In further aspects, once the locking dogs 114 have moved to their second, inward position mechanically coupling the operating connector 112 to the operating mandrel 116, the locking dogs 114 cannot be shifted outward to their original first position, and thus the operating connector 112, locking dogs 114, and operating mandrel 116 cannot be uncoupled. Accordingly, once the locking dogs 114 mechanically couple the operating connector 112 and the operating mandrel 116, when the operating mandrel 116 moves within the tool string, in an uphole, downhole, or rotational direction, the operating connector 112 is also moved in the corresponding direction, and along the exterior of the ball cage 108. The movement of the operating connector 112 is translated to and actuates the operating arm 110 a proportional distance, which in turn translates the motion to the ball 106*b*, shifting the ball-and-seat valve 106 between an open and a closed position.

The operating case 102 can further at least partially encase and support a nipple structure 118. The nipple structure 118 has an uphole nipple flange 118*a*, a nipple core 118*b*, and a downhole nipple flange 118*c*. The nipple structure 118 further encases at least a portion of the operating mandrel 116, but allows for motion of the operating mandrel 116 through the interior space defined by the nipple structure 118. The operating mandrel shoulders 116*c* have a range of motion that directly correlates to the motion of the operating mandrel 116. The downhole nipple flange 118*c* is partially hollowed and can be configured to accommodate at least an air gap, a biasing element, and a piston 120. In embodiments, two downhole nipple flanges 118*c* extend in a downhole direction on opposing sides of the operating mandrel 116, where each downhole nipple flange 118*c* has a hollowed space that is adapted to contain a locking piston 120. In alternative embodiments, either one or both of the uphole nipple flange 118*a* and downhole nipple flange 118*c* can surround a fraction of or the entire circumference of the operating mandrel 116. In alternative embodiments, a retaining sleeve that can surround a fraction of or the entire circumference of the operating mandrel 116 can be used in lieu of one or more pistons within the nipple structure 118.

Each locking piston 120 in a downhole nipple flange 118*c* is movable between a first and a second position, dependent on the annulus pressure and pressure from the biasing member on the uphole side of the locking piston 120 and the annulus pressure on the downhole side of the locking piston 120. Each locking piston 120 is tapered or otherwise shaped to have a larger surface area on its downhole side relative to the surface area on the uphole side of the locking piston 120. When the annulus pressure is the same on both sides of the piston, the larger surface area of the downhole side of a locking piston 120 allows for the annulus pressure on the downhole side of the locking piston 120 to exert greater force on the locking piston 120 than the annulus pressure can exert on the uphole side of the piston 120 having a smaller surface area. Thus, the locking piston 120 will be urged toward the uphole direction within the hollowed out portion of a downhole nipple flange 118*c*, in the absence of any additional biasing member or opposing force on the uphole side of the locking piston 120.

A lock case 124 can at least partially encase and support the nipple structure 118, particularly the downhole nipple flange 118*c*, and can also at least partially encase and support the operating mandrel 116. The lock case 124 allows for motion of the operating mandrel 116 through the interior space defined by the lock case 124. The interior space defined by the lock case 124 is further configured to have a wider interior diameter on the uphole side of the lock case 124 relative to the interior diameter of the downhole side of the lock case 124. The uphole interior diameter of the lock case 124 is sufficiently wide to allow for the downhole nipple flange 118*c* to fit in between the lock case 124 and operating mandrel 116. The uphole interior diameter of the lock case 124 is also sufficiently wide to accommodate at least one slide-locking dog 122 positioned along the exterior of the operating mandrel 116, downhole of the nipple structure 118, and encased by the lock case 124. In embodiments, a pair of slide-locking dogs 122 can be located on opposite sides of the operating mandrel 116. In further embodiments, an individual slide-locking dog 122 can be located along the exterior of an operating mandrel 116 proximate to each operating mandrel shoulder 116*c* projecting from the operating mandrel 116. In yet further embodiments, a slide-locking dog 122 can surround a fraction of or the entire circumference of the operating mandrel 116. The slide locking dogs 122 are moveable from a first, inward position (relatively closer to the longitudinal axis or centerline of the tool string) to a second, outward position (relatively closer to the exterior of the tool string).

When in the first, inward position, the slide-locking dogs 122 obstruct the range of motion of the operating mandrel shoulders 116*c*. The slide-locking dogs 122 and operating mandrel shoulders 116*c* are shaped to interface at an angle that is not perpendicular to the longitudinal axis of the tool string, i.e. the interface between the slide-locking dogs 122 and operating mandrel shoulders 116*c* is slanted to allow for some movement and give between the two elements. Accordingly, the interfacing surfaces of the operating mandrel shoulders 116*c* and slide-locking dogs 122 are designed to slide against each other, allowing the slide-locking dogs 122 to be urged from the first, inward position to the second, outward position when the operating mandrel 116 moves in the uphole direction or in a rotational direction. Similarly, the operating mandrel shoulders 116*c* and slide-locking dogs 122 are designed to also allow the slide-locking dogs 122 to slide along the operating mandrel shoulders 116*c* from the second, outward position to the first, inward position when the operating mandrel 116 moves in the downhole direction or in a rotational direction.

In embodiments, when the tool string having a pressure dependent actuator and operating mandrel 116 is in a first position 100, the operating mandrel shoulders 116*c* are located within the uphole interior diameter of the lock case 124. In this position, the slide-locking dogs 122 are held in their second, outward position, in contact with the surface of the operating mandrel shoulders 116*c*. The downhole interior diameter of the lock case 124 is wide enough to accommodate the width of the operating mandrel 116 including the width added by the operating mandrel shoulders 116*c*. Thus, the operating mandrel 116 can move in both an uphole and downhole direction through the lock case 124. In alternative embodiments, the operating mandrel 116 can move in a rotational direction, around a longitudinal axis of the tool string, between a first mandrel position (or orientation) and a second mandrel position that is rotationally offset from the first mandrel position. The uphole interior volume of the lock case 124 is configured such that the at least one locking piston 120, if extended by a biasing member out of the hollowed portion of the downhole nipple flange 118*c*, the at least one locking piston 120 can extend partially into the uphole interior volume of the lock case 124. In a first position 100, however, the at least one locking piston 120 cannot move into the uphole interior volume of the lock case 124 because the at least one slide-locking dog 122 occupies a substantial space of the lock case 124 uphole interior volume. In aspects, the at least one locking piston 120 cannot extend into the interior volume of the lock case 124 when the slide-locking dog 122 is in the second, outward position in that volume. Vice versa, a slide-locking dog 122 cannot move from a first, inward position to the second, outward position when a locking piston 120 is extended and occupying a significant space of the lock case 124 uphole interior volume.

In the tool string, the downhole end of the operating mandrel 116 is configured to be coupled with the uphole side of a nitrogen mandrel 126. In aspects, the operating mandrel 116 has a second interior volume 116*b*, where the diameter of the second interior volume 116*b* is configured to couple and match with the diameter of the interior volume of the nitrogen mandrel 126*b*. The nitrogen mandrel 132 is at least in part encased and supported by a nitrogen connector 128, where the nitrogen connector 128 is further mechanically coupled or in contact with the downhole side of the operating mandrel 116. The nitrogen connector 128 provides nitrogen to the wellbore environment, via the nitrogen mandrel 126*b*, and can accordingly change the annulus pressure of the wellbore environment in the area of the operating mandrel 116 to affect pressure dependent changes in the region.

The nitrogen mandrel 126 has an interior volume 126*b* through which nitrogen gas can be provided through a nitrogen filter port (not shown) to the tool string system. A metering system (not shown) can be provided that can establish and allows for a pressure differential between an section of the tool string primarily subject to annulus pressure and a section of the tool string primarily subject to the pressure resulting from nitrogen gas provided to the tool string system. The introduction of nitrogen gas, in combination with or in opposition to the annulus pressure, can exert force on the operating mandrel 116 to move the operating mandrel 116 so as to actuate the operating arm 110. In some aspects, the operating mandrel 116 is moved when the pressure of the nitrogen gas exerts a sufficient force on the operating mandrel 116 that overcomes an opposing force on the operating mandrel 116 from the either or both of the annulus pressure and a collet 132. The nitrogen gas may exert a sufficient force on the operating mandrel 116 when the opposing annulus pressure is bled off from the related section of the tool string. In other aspects, the operating mandrel 116 is moved when the annulus pressure exerts a sufficient force on the operating mandrel 116 that overcomes an opposing force on the operating mandrel 116 from the either or both of the pressure from nitrogen gas and a collet 132.

In embodiments, other gases may be provided through the nitrogen mandrel interior volume 126*b* in combination with or alternatively to nitrogen gas. The nitrogen mandrel 126 can further include nitrogen mandrel shoulders 126*a* which can be lateral or longitudinal projections extending from the exterior surface of the nitrogen mandrel 126. The nitrogen mandrel shoulders 126*a* increase the exterior diameter of the nitrogen mandrel 126 along the length of the nitrogen mandrel shoulders 126*a*. In aspects, there may be at least one nitrogen mandrel shoulder 126*a*, nitrogen mandrel shoulders 126*a* on opposing sides of the nitrogen mandrel 126, a plurality of nitrogen mandrel shoulders 126*a* around the circumference of the nitrogen mandrel 126, or a nitrogen mandrel shoulder 126*a* that partially or completely surrounds the exterior circumference of the nitrogen mandrel 126. The nitrogen mandrel shoulders 126*a* are designed to mechanically couple with collets 132 that generally keep the entire mechanically connected tool apparatus in the same location relative to the overall tool string. The collets 132 and nitrogen mandrel shoulders 126*a* are shaped to interface at an angle that is not perpendicular to the longitudinal axis of the tool string, i.e. the interface between the collets 132 and nitrogen mandrel shoulders 126*a* is slanted to allow for some movement and give between the two elements. The pressure on either the downhole or uphole side of the operating mandrel 116 or nitrogen mandrel 126, however, can increase to overcome the friction at the interface between the collets 132 and nitrogen mandrel shoulders 126*a* such that the collets 132 are pushed toward the exterior of the wellbore and jump the nitrogen mandrel shoulders 126*a*, allowing the nitrogen mandrel shoulders 126*a* and the correlated nitrogen mandrel 126 to move in an uphole or downhole direction.

Figure 1B:
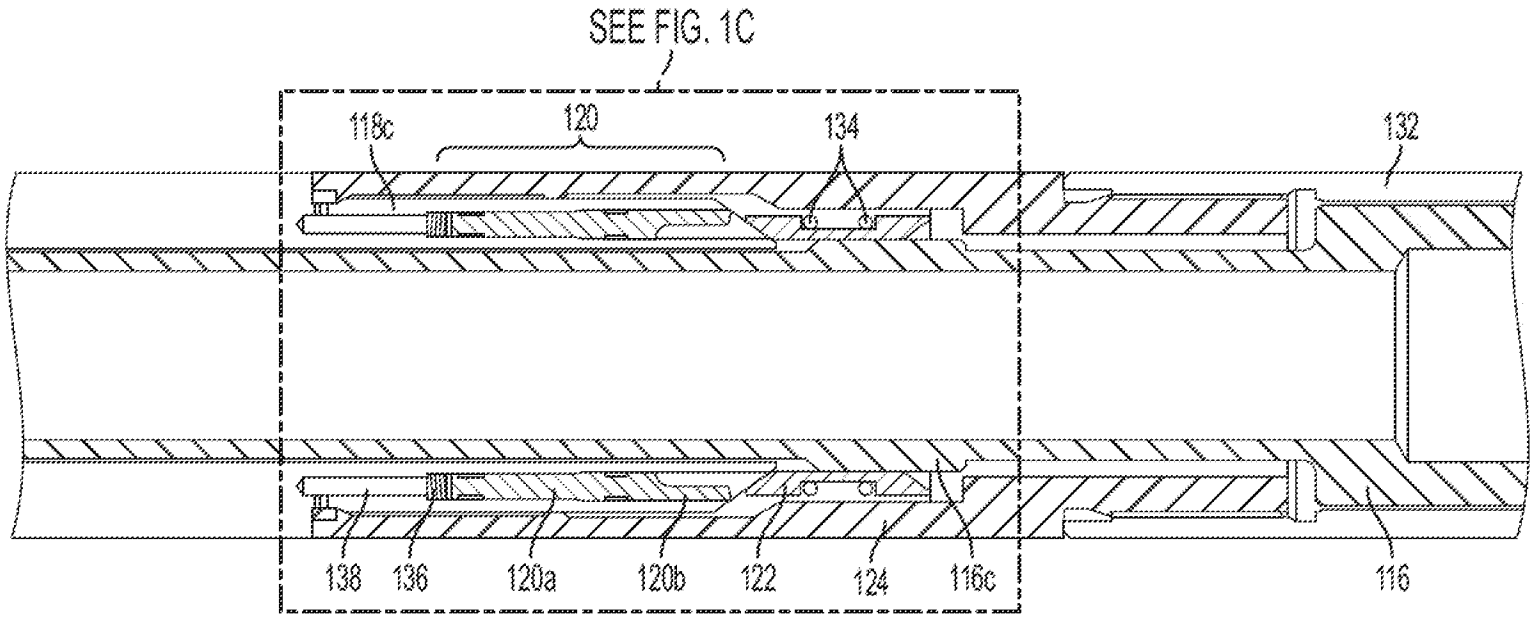
FIG. 1B is a detail section of FIG. 1A, further focusing on the pressure dependent actuator mechanism in the first position, according to one aspect of the present disclosure.

FIG. 1B is a detail section of FIG. 1A, further focusing on the pressure dependent actuator mechanism in the first position, according to one aspect of the present disclosure. As seen in FIG. 1A, the operating mandrel shoulders 116*c* are located within the uphole interior diameter of the lock case 124. In this position, the slide-locking dogs 122 are held in their second, outward position, in contact with the surface of the operating mandrel shoulders 116*c*. The slide-locking dogs 122 are seen in further detail, residing within the interior space of the lock case 124, urged outward toward the exterior of the wellbore by the operating mandrel shoulders 116*c*. Lock-biasing springs 134 are positioned between the slide-locking dogs 122 and the lock case 124, and urge the slide-locking dog 122 toward the interior of the wellbore and into contact with the operating mandrel 116 or the operating mandrel shoulders 116*a*. In aspects, the lock-biasing springs 134 by themselves do not exert a sufficient force on the slide-locking dogs 122 to hold the slide-locking dogs 122 in place as the operating mandrel shoulders 116*c* move in an uphole direction. In some embodiments, a slide-locking dog 122 can be biased with a single lock-biasing spring 134, while in other embodiments, a slide-locking dog 122 can be biased with two or more lock-biasing springs 134.

The locking pistons 120 residing in the hollowed portion of the downhole nipple flange 118*c* are seen in further detail to include a locking piston uphole end 120*a* and a locking piston downhole end 120*b*. The locking piston uphole end 120*a* has relatively narrower profile and surface area than the profile and surface area of the locking piston downhole end 120*b*. The locking piston uphole end 120*a* is further in contact with a biasing element that applies pressure to the locking piston uphole end 120*a*, which in embodiments is a piston-biasing spring 136. In embodiments where the locking piston 120 is a sleeve that surrounds the operating mandrel 116, the piston-biasing spring 136 can similarly be a spring that surrounds the operating mandrel 116 such that it remains in contact with a substantive portion of the locking piston uphole end 120*a*. In addition to a biasing element, an air gap 138 in the downhole nipple flange 118*c* allows for the annulus pressure of the wellbore environment to exert pressure on the locking piston uphole end 120*a*. Thus in aspects, the locking piston uphole end 120*a* has both the force of the annulus pressure and the piston-biasing spring 136 applying pressure and urging the locking piston 120 in the downhole direction in opposition to the force of the annulus pressure on the downhole locking piston end 120*b* urging the locking piston 120 in the uphole direction. The locking piston 120 will not extend out of the hollow downhole nipple flange 118*c* if the force of the annulus pressure on the downhole locking piston end 120*b* is greater than the combined force of the piston-biasing spring 136 and annulus pressure on the uphole locking piston end 120*a*. Further, when the operating mandrel 116 is in a first position such that the slide-locking dogs 122 are in their second, outward position, the slide-locking dogs 122 can prevent the locking pistons 120 from extending into the uphole interior volume of the lock case 124.

Figure 1C:
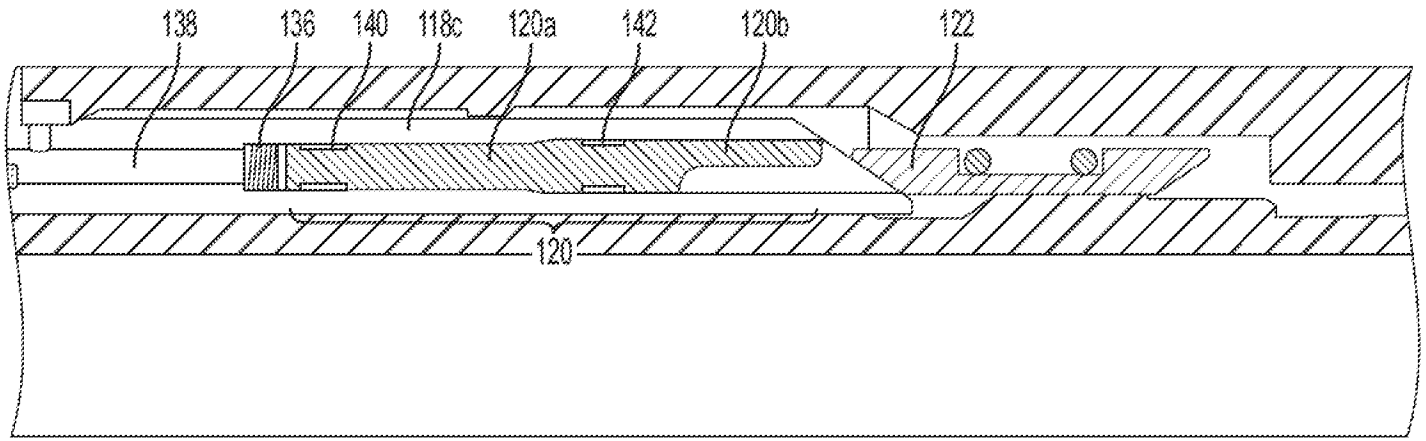
FIG. 1C is a detail section of FIG. 1B, further focusing on a locking piston in a first position, a slide-locking dog in a first position, and having a spring as a piston-biasing member, according to one aspect of the present disclosure.

FIG. 1C is a detail section of FIG. 1B, further focusing on a locking piston 120 in a first position, a slide-locking dog 122 in a first position, and having a piston-biasing spring 136 as a biasing member. The further detail of the locking piston 120 illustrates that the exterior of the locking piston 120 is shaped to have a profile that narrows the thickness along a portion of the locking piston uphole end 120*a* and along a portion of the locking piston downhole end 120*b*. In particular, the thickness or circumference of a first section of the locking piston uphole end 120*a* is cut away, tapered, or reduced such that a first air seal 140 is formed by the space between the locking piston 120 and the downhole nipple flange 118*c* along that first section. Similarly, the thickness or circumference of a second section of the locking piston downhole end 120*b* is cut away, tapered, or reduced such that a second air seal 142 is formed by the space between the locking piston 120 and the downhole nipple flange 118*c* along that second section. The first air seal 140 and second air seal 142 can function to maintain the differential between the annulus pressure on either side of the locking piston 120 as it moves upward or downward through the wellbore as part of the tool string.

Figure 1D:
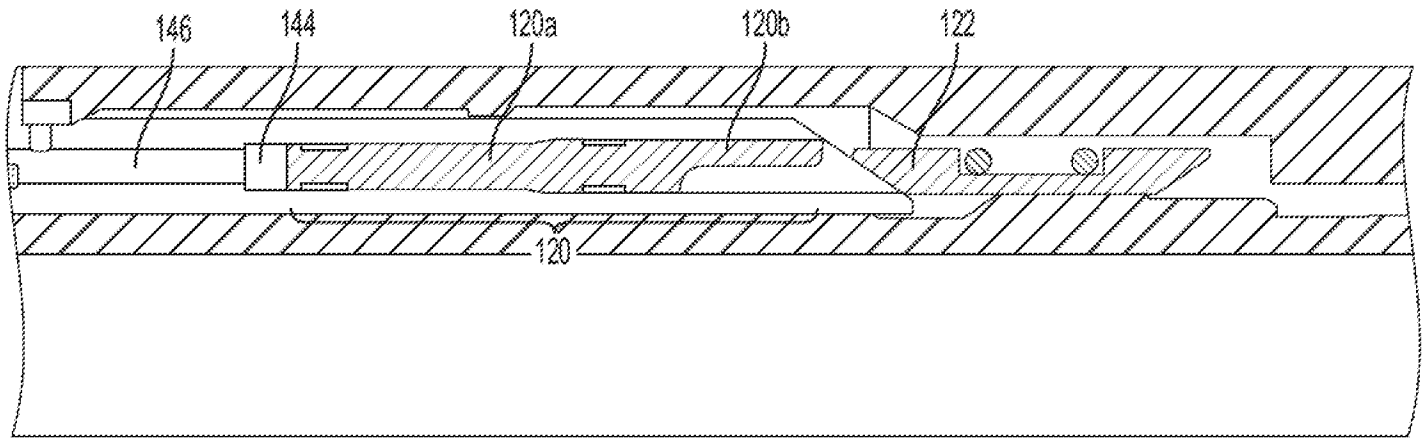
FIG. 1D is an alternative embodiment of the detail section of FIG. 1B, further focusing on a locking piston in a first position, a slide-locking dog in a first position, and having a compressed volume as a piston-biasing member, according to one aspect of the present disclosure.

FIG. 1D is an alternative embodiment of the detail section of FIG. 1B, further focusing on a locking piston 120 in a first position, a slide-locking dog 122 in a first position, and having a compressed volume of gas 144 as a biasing member. In such embodiments, the compressed gas 144 is not in contact with any annulus fluid or subject to the annulus pressure of the wellbore. Rather, the compressed gas 144 is in contact with a solid seal 146, which operates to contain the compressed gas 144, isolating the compressed gas 144 from the annulus pressure of the annulus fluid in the wellbore. Accordingly, as annulus pressure changes on the downhole locking piston end 120*b*, the compressed gas 144 maintains its pressure and force on the uphole locking piston end 120*a*. In aspects, the solid seal 146 can be a piston residing in a part of the downhole nipple flange 118*c*, while in other aspects the solid seal 146 can simply be the structure of the nipple flange 118 without any fluidic connection to the wellbore environment. Thus in aspects, the locking piston uphole end 120*a* has the force of the compressed gas 144 applying pressure and urging the locking piston 120 in the downhole direction in opposition to the force of the annulus pressure on the downhole locking piston end 120*b* urging the locking piston 120 in the uphole direction. The locking piston 120 will not extend out of the hollow downhole nipple flange 118*c* if the force of the annulus pressure on the downhole locking piston end 120*b* is greater than the force of the compressed gas 144 on the uphole locking piston end 120*a*.

Figure 2A:
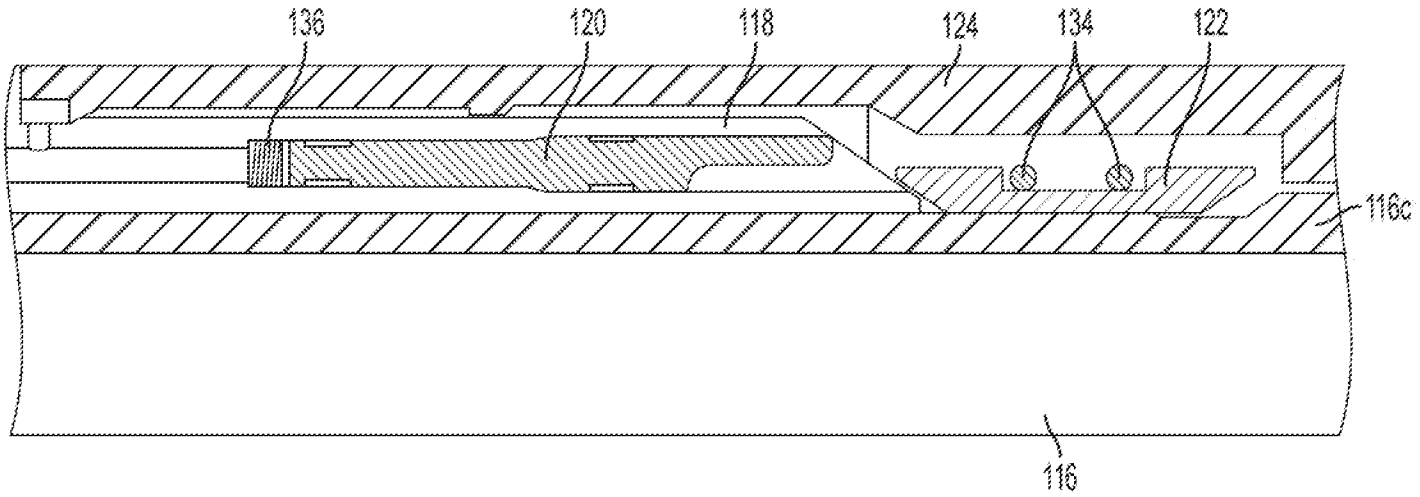
FIG. 2A is a side profile schematic illustration of an example of a pressure dependent actuator and connected mandrel in a second position, focused on the detail section of the area identified by FIG. 1B, further focusing on a locking piston in a first position, a slide-locking dog in a second position, and having a spring as a biasing member, according to one aspect of the present disclosure.

FIG. 2A is a side profile schematic illustration of an example of a pressure dependent actuator and connected mandrel in a second position, focused on the detail section of the area identified by FIG. 1B, further focusing on a locking piston in a first position, a slide-locking dog in a second position, and having a spring as a biasing member. When the operating mandrel 116 is in a second position, the operating mandrel shoulders 116*c* are within the downhole interior volume of the lock case 124 and are not in contact with the slide-locking dog 122. The lock-biasing springs 134 urge the slide-locking dog 122 to a first, inward position to be in contact with the exterior surface of the operating mandrel 116. With the slide-locking dog 122 in its inward position, the uphole interior volume of the lock case 124 is available for the locking piston 120 to extend into. As illustrated in FIG. 2A, the locking piston 120 remains within the hollow portion of the downhole nipple flange 118*c*, a condition where the force applied to the uphole locking piston end 120*a* by the piston-biasing spring 136 and the annulus pressure (via the air gap 138) is not sufficient to overcome the force applied to the downhole locking piston end 120*b* by the annulus pressure.

Figure 2B:
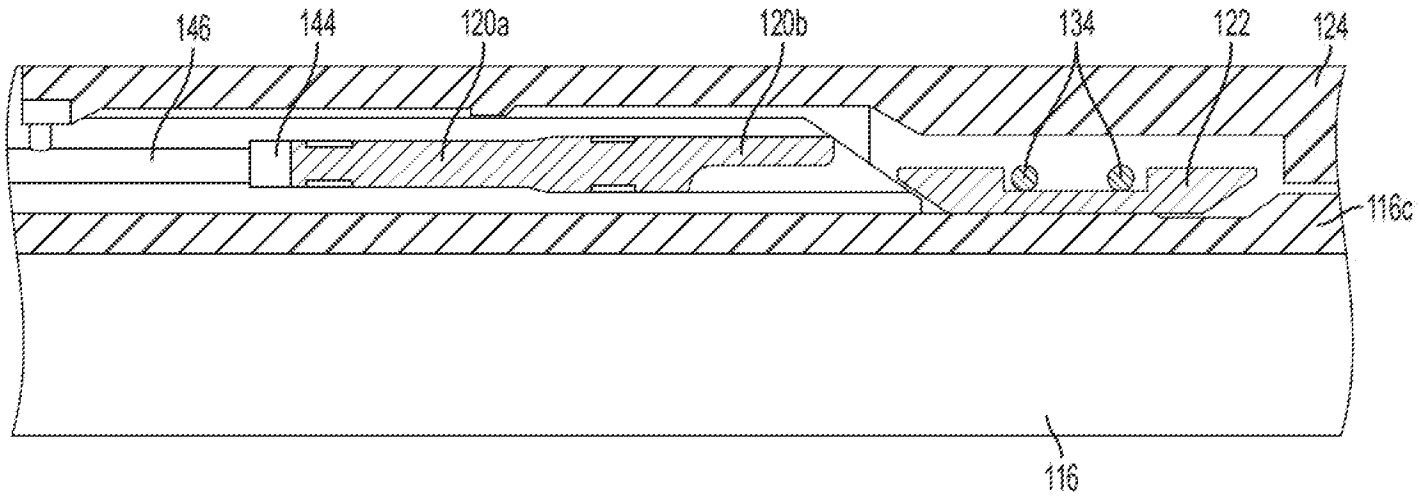
FIG. 2B is a side profile schematic illustration of an example of a pressure dependent actuator and connected mandrel in a second position, focused on the detail section of the area identified by FIG. 1B, further focusing on a locking piston in a first position, a slide-locking dog in a second position, and having a compressed volume as a biasing member, according to one aspect of the present disclosure.

FIG. 2B is a side profile schematic illustration of an example of a pressure dependent actuator and connected mandrel in a second position, focused on the detail section of the area identified by FIG. 1B, further focusing on a locking piston in a first position, a slide-locking dog in a second position, and having a compressed volume as a biasing member. In such embodiments, a compressed gas 144 blocked from annulus fluid by a solid seal 146 is utilized as the biasing member, such that as the annulus pressure changes with a correlated force exerted on the downhole locking piston end 120*b*, the compressed gas 144 maintains its pressure on the uphole locking piston end 120*a*. As in the embodiment illustrated in FIG. 2A, when the operating mandrel 116 is in a second position, the operating mandrel shoulders 116*c* are within the downhole interior volume of the lock case 124 and are not in contact with the slide-locking dog 122. The lock-biasing springs 134 urge the slide-locking dog 122 to a first, inward position to be in contact with the exterior surface of the operating mandrel 116. With the slide-locking dog 122 in its inward position, the uphole interior volume of the lock case 124 is available for the locking piston 120 to extend into. As illustrated in FIG. 2B, the locking piston 120 remains within the hollow portion of the downhole nipple flange 118*c*, a condition where the force applied to the uphole locking piston end 120*a* by the compressed gas 144 is not sufficient to overcome the force applied to the downhole locking piston end 120*b* by the annulus pressure.

Figure 3A:
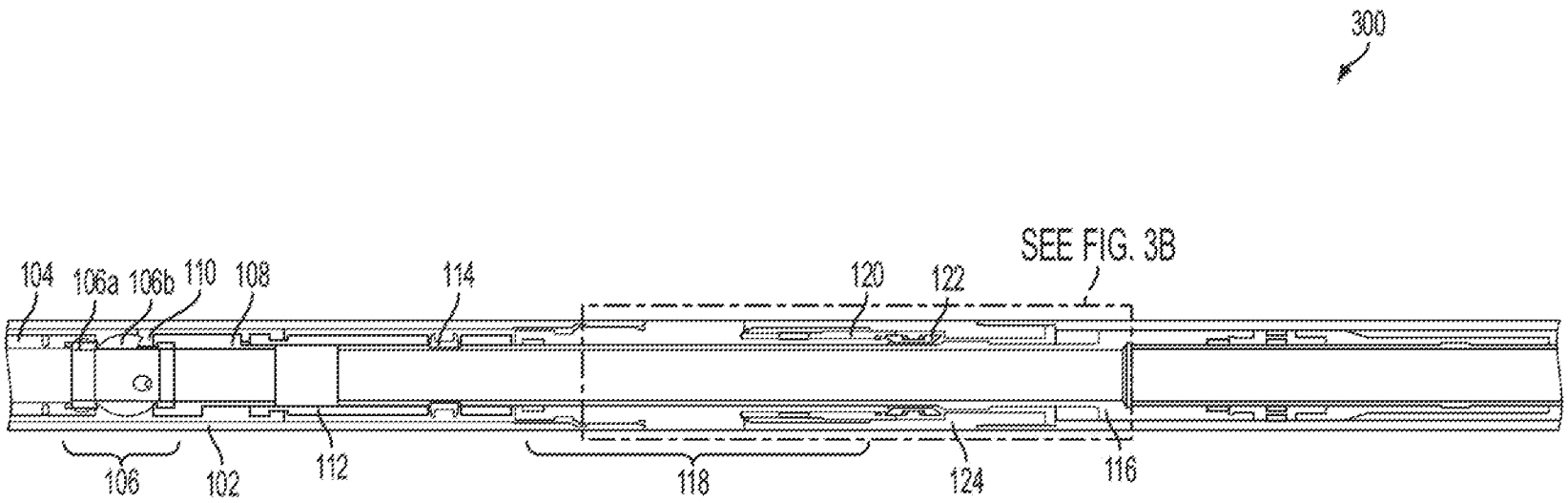
FIG. 3A is a side profile schematic illustration of an example of a pressure dependent actuator, connected to a mandrel in a second position and a valve in an open position, according to one aspect of the present disclosure.

FIG. 3A is a side profile schematic illustration of an example of a pressure dependent actuator and connected mandrel in a second position 300. In this configuration, the operating mandrel 116 is, relative to the first position illustrated in FIG. 1A, shifted in the downward or downhole direction. Accordingly, the slide-locking dogs 122 are in a first, inward position and the locking pistons 120 are projected into the uphole interior volume of the lock case 124. Similarly, the movement of the operating mandrel 116 is translated to the operating connector 112 and operating arm 110, shifting those elements in the downhole direction. Thus, operating arm has actuated the ball 106*b* to rotate within the seat 106*a*, placing the ball-and-seat valve 106 into an open valve orientation. In the open valve orientation, the interior volumes of the retainer 104, ball-and-seat valve 106, the ball cage 108, operating connector 112, and operating mandrel 116 are all in fluidic communication with each other.

With the locking pistons 120 projected into the uphole interior volume of the lock case 124, the slide-locking dogs 122 are unable to freely move into the same uphole interior volume of the lock case 124. Accordingly, the operating mandrel 116 is blocked from further movement within the tool string in the uphole direction because if the operating mandrel 116 is urged in the uphole direction, the operating mandrel shoulders 116*c* are blocked and obstructed by the slide-locking dogs 122. Thus, the slide-locking dogs 122 cannot slide along the surface of the operating mandrel shoulders 116*c* from the first, inward position to the second, outward position, and therefore the operating mandrel 116 is prevented from moving in the uphole direction.

Figure 3B:
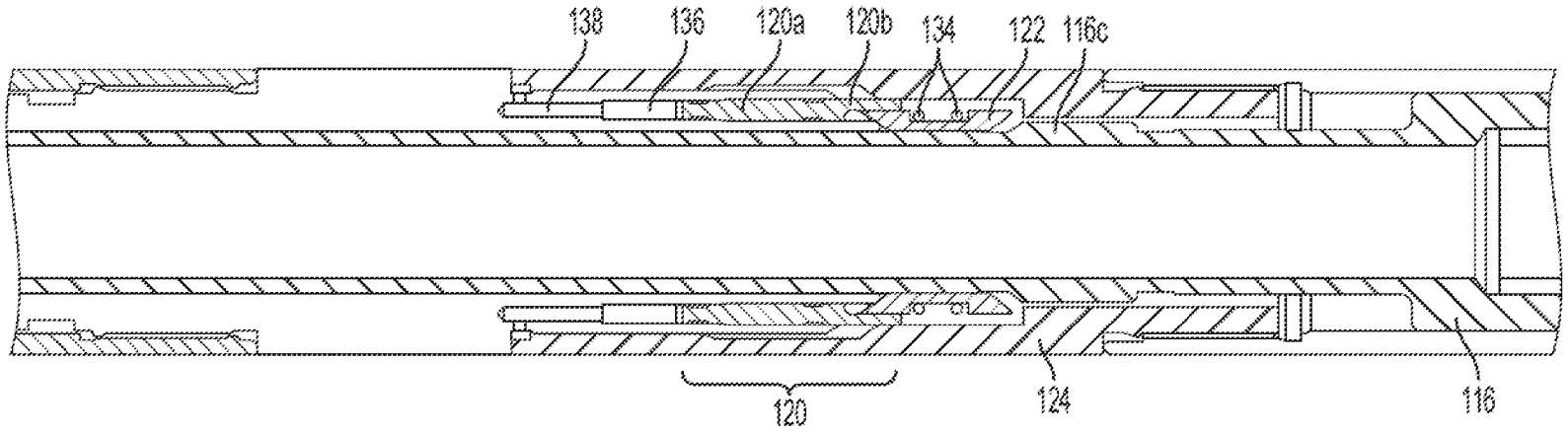
FIG. 3B is a detail section of FIG. 3A, further focusing on the pressure dependent actuator mechanism in the second position, according to one aspect of the present disclosure.

FIG. 3B is a detail section of FIG. 3A, further focusing on the pressure dependent actuator mechanism in the second position. The locking piston 120 is projected at least in part into the uphole interior volume of the lock case 124. In particular, the downhole locking piston end 120*b* is projected into the uphole interior volume of the lock case 124 and blocks the slide-locking dog 122 from moving into that space. The piston-biasing member is a piston-biasing spring 136 which is extended as shown in FIG. 3B. The locking piston 120, being extended at least in part from the hollow portion of the downhole nipple flange 118*c*, results from a condition where the force applied to the uphole locking piston end 120*a* by the piston-biasing spring 136 and the annulus pressure (via the air gap 138) is sufficient to overcome the force applied to the downhole locking piston end 120*b* by the annulus pressure.

Figure 3C:
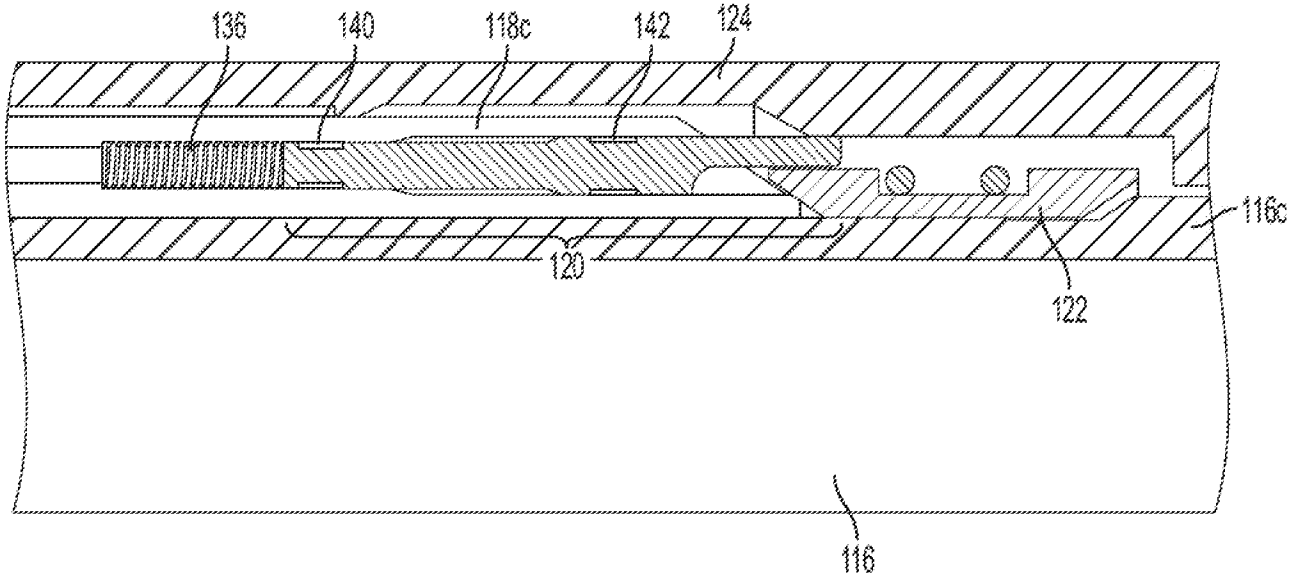
FIG. 3C is a detail section of FIG. 3B, further focusing on a locking piston in a second position, a slide-locking dog in a second position, and having a spring as a piston-biasing member, according to one aspect of the present disclosure.

FIG. 3C is a detail section of FIG. 3B, further focusing on a locking piston 120 in a second position, a slide-locking dog 122 in a second position, and having a piston-biasing spring 136 as a biasing member. As illustrated, the piston-biasing spring 136 is extended in length, pushing the locking piston 120 to project partially out of the hollow portion of the downhole nipple flange 118*c* and into the uphole interior volume of the lock case 124. The first air seal 140 and second air seal 142 are not broken by movement of the locking piston 120 from to a position projected at least in part into the uphole interior volume of the lock case 124. The slide-locking dog 122 is obstructed from moving in an outward direction, thus blocking the operating mandrel shoulders 116*c* from moving in an uphole direction, and accordingly preventing movement of the operating mandrel 116 in the uphole direction within the tool string.

Figure 3D:
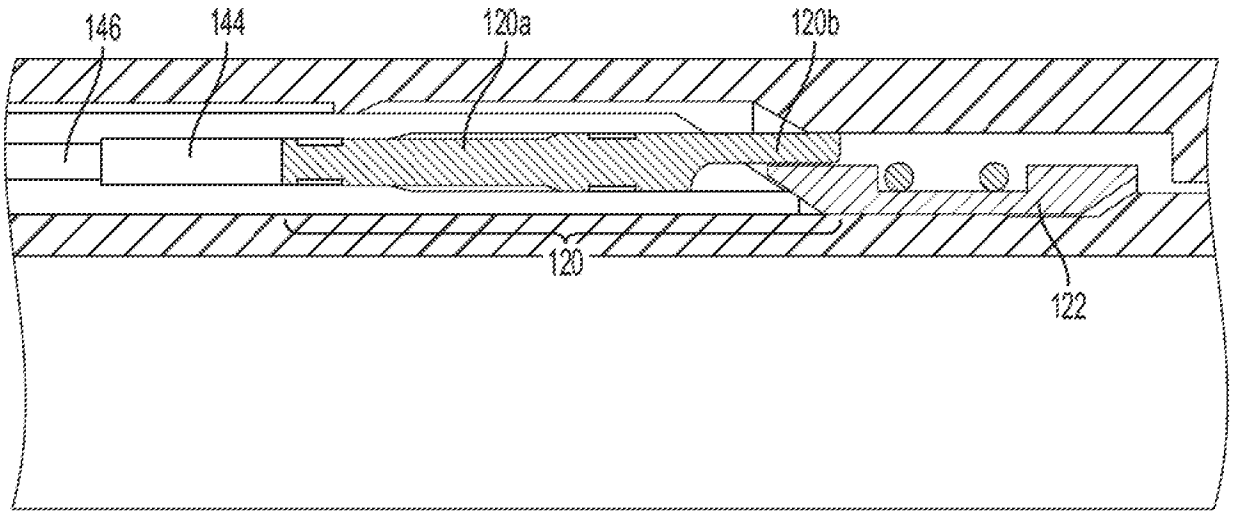
FIG. 3D is an alternative embodiment of the detail section of FIG. 3B, further focusing on a locking piston in a second position, a slide-locking dog in a second position, and having a compressed volume as a piston-biasing member, according to one aspect of the present disclosure.

FIG. 3D is an alternative embodiment of the detail section of FIG. 3B, further focusing on a locking piston 120 in a second position, a slide-locking dog 122 in a second position, and having a compressed gas 144 as a piston-biasing member. In such embodiments, a compressed gas 144 is utilized as the biasing member, such that as the annulus pressure changes with a correlated force exerted on the downhole locking piston end 120*b*, the compressed gas 144 maintains its pressure on the uphole locking piston end 120*a*. As illustrated in FIG. 3D, the locking piston 120 is projected out of the hollow portion of the downhole nipple flange 118*c*, a condition where the force applied to the uphole locking piston end 120*a* by the compressed gas 144 and the pressure of the annulus fluid 146 is sufficient to overcome the force applied to the downhole locking piston end 120*b* by the annulus pressure.

In alternative embodiments, the operating mandrel 116 may be shifted in a rotational direction, where the rotational motion translates motion to the operating connector 112 and operating arm 110, actuating those elements and thereby actuating the ball 106*b* to rotate within the seat 106*a*. In such embodiments, when a locking piston 120 is extended at least in part from the hollow portion of the downhole nipple flange 118*c*, the locking piston 120 can obstruct the slide-locking dog 122 from moving in an outward direction. Thus, the slide-locking dog 122 can block the operating mandrel shoulders 116*c* from moving in a rotational direction, and accordingly prevent movement of the operating mandrel 116 in the rotational direction within the tool string.

In additional or alternative aspects, the volume containing the pressurized gas 144 may instead contain a compressible liquid, compressible gel, or compressible solid, that can expand and exert force on a locking piston 120 as a biasing member.

In embodiments, the operating pressure of the tool string, the actuating mechanism, and the valve can be from about 500 psi to about 3000 psi. The operating pressure of the tool string, actuating mechanism, and valve can vary depending on the size of the tool string, the temperature of the wellbore, and hydrostatic pressure within the wellbore. In aspects, the tool string, actuating mechanism, valve, and other components can have an absolute pressure rating of greater than 35,000 psi. In embodiments, the tool string can support an overall maximum tensile load of about 367,000 pounds and an overall maximum torque load of about 10,000 foot-pounds. In other embodiments, the maximum tensile load and maximum torque load may vary significantly based upon the size and material of the tool string.

Figure 4:
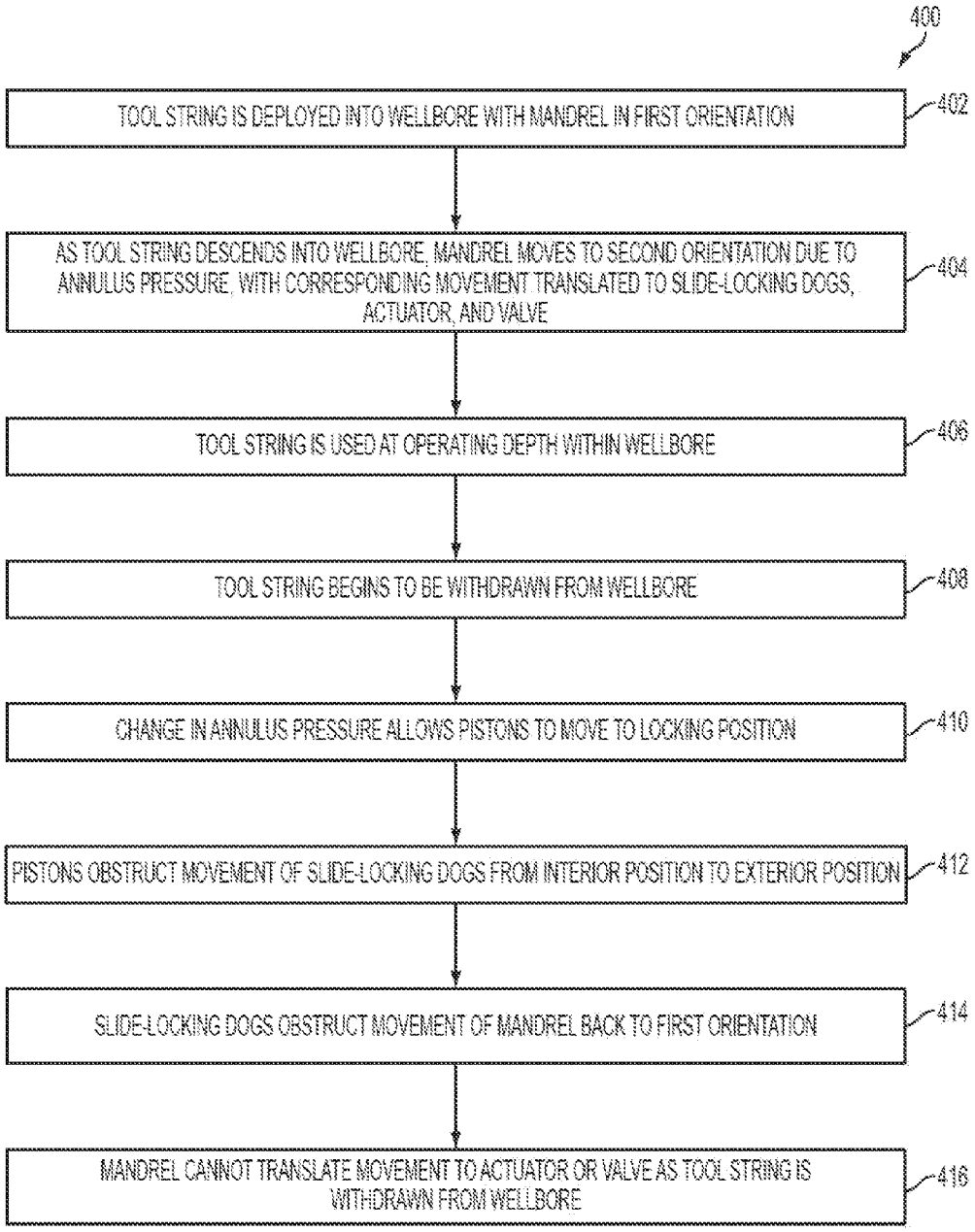
FIG. 4 is a flowchart illustrating an example method for operating a wellbore tool assembly that includes a pressure dependent actuator, according to one aspect of the present disclosure.

FIG. 4 is a flowchart illustrating an example method 400 for operating a wellbore tool assembly that includes a pressure dependent actuator and a valve. For example, a tool string or tool assembly deployed into a wellbore may include components or devices (e.g. a ball-and-seat valve 106) that is to be locked in a first, closed position during deployment of the tool string and actuated to second, open position after the tool string is positioned at a desired location in the wellbore. Non-limiting examples of the movement and structure of the tool string and associated components are described above with respect to FIGS. 1-3.

At block 402, a tool string is deployed into a wellbore. The tool string can include a mandrel 116, a valve 106, locking dog mechanisms 114, slide-locking dog mechanisms 122, an actuating mechanism such as an operating arm 110, other tool string apparatus, or a combination thereof, where movement of the mandrel 116 is pressure dependent. In one non-limiting example, deploying a tool string can be performed with the mandrel 116 in a first mandrel position or orientation, in a configuration where the valve 106 is not mechanically coupled, directly or indirectly, with the mandrel 116 during descent of the tool string into the wellbore. In such embodiments, the motion of the mandrel 116 will not cause the actuating mechanism to shift the valve 106 between a closed orientation and open orientation until the mandrel 116 is mechanically coupled by the engagement of the locking dog mechanism 114 to the actuating mechanism. In some aspects, the valve 106 can be in a closed position as the tool string is deployed.

At block 404, as the tool string descends into the wellbore, the mandrel 116 becomes engaged with the actuating mechanism due to the engagement of the locking dogs 114 that mechanically couple the mandrel to the actuating mechanism. Accordingly, the motion of the mandrel 116 translates into motion of the actuator. The annulus pressure of the wellbore can cause the mandrel 116 to move in a direction toward a second mandrel position or orientation that causes a corresponding motion of the actuating mechanism, the actuating mechanism being coupled to the valve 106 and shifting the valve 106 to an open orientation. The movement of the mandrel 116 can subsequently or concurrently allow for the movement of slide-locking dogs 122 to a position toward the centerline and interior of the tool string.

At block 406, the tool string having a mandrel 116 at a second positions, and in aspect having a valve 106 in an open orientation, can be at an operating depth within the wellbore. The open valve 106 allows for the flow of fluids, slurry, hydrocarbon, water, and the like to fill within compartments of the tool string for collection, testing, or other applications.

At block 408, once operation of the tool string at the desired depth is complete, the tool string can begin to be withdrawn from the wellbore.

At block 410, the change in annulus pressure on the locking pistons 120, generally diminishing as the tool string is drawn out of the wellbore, allows for at least one piston-biasing member to urge the locking pistons 120 toward their locking position, i.e. projected out from a structure in which the locking pistons reside. As the tool string is withdrawn, unless the valve 106 is locked in an open orientation, the valve 106 will close due to the motion of the mandrel 116, and any fluid, slurry, or other matter within the tool string compartments will be held within the tool string as it is brought to the surface of the wellbore.

At block 412, the locking pistons 120 block the slide-locking dogs 122 from moving to a valve closed orientation. More particularly, with the locking pistons 120 in a locking position, the slide-locking dogs 122 are blocked from moving away from the centerline of the tool string, i.e. from a position toward the interior of the tool string to a position toward the exterior of the tool string.

At block 414, the slide-locking dogs 122 block the mandrel 116 from moving to a valve closed orientation. More particularly, with slide-locking dogs 122 in a position toward the centerline of the tool string, the mandrel 116, or parts of the mandrel 116, are blocked from moving within the tool string, either along or around the longitudinal axis of the tool string, back to a first mandrel position or orientation.

At block 416, because the mandrel 116 cannot move to a first mandrel position or orientation, the mandrel 116 cannot translate motion through the actuator to the valve 106 to close the valve 106. Thus, the valve 106 remains open as the tool string is withdrawn from the wellbore, allowing any fluid, slurry, or other matter to drain from the tool string.

In some aspects of the present disclosure, a pressure-dependent locking assembly is provided. The pressure-dependent locking assembly can include a mandrel movable between a first mandrel position and a second mandrel position within a tool string, where the body of the includes at least one mandrel shoulder, at least one slide-locking dog, proximate to the at least one mandrel shoulder, movable laterally between a first inward position and a second outward position, and is operable to block movement of the at least one mandrel shoulder and mandrel, at least one locking piston, proximate to the at least one slide-locking dog, movable between a first piston position and a second piston position, and is operable to block movement of the slide-locking dog, and a biasing member proximate to an end of the at least one locking piston, where the biasing member is operable to move the locking piston to the second piston position, that operates to move the locking piston to the second position at or below a particular annulus pressure. In aspects, the pressure-dependent locking assembly can include at least one locking piston, which when in a second piston position, the slide-locking dog is blocked from moving to a second outward position. In other aspects, the pressure-dependent locking assembly can include at least one slide-locking dog which, when in the first inward position, the slide-locking dog obstructs the range of motion of the mandrel shoulder and blocks motion of the mandrel. In alternative aspects, the pressure-dependent locking assembly can include a biasing member which is a spring, or a biasing member which is a compressed gas. In further aspects, the pressure-dependent locking assembly can have the first mandrel position and the second mandrel position be at different locations along a longitudinal axis of the tool string. In other aspects, the pressure-dependent locking assembly can have the second mandrel position be rotationally offset from the first mandrel position around a longitudinal axis of the tool string.

In some aspects of the present disclosure, a pressure-dependent locking and valve assembly is provided. The pressure-dependent locking and valve assembly can include a mandrel movable between a first mandrel position and a second mandrel position within a tool string, where the body of the mandrel includes at least one mandrel shoulder, at least one slide-locking dog, proximate to the at least one mandrel shoulder, movable laterally between a first inward position and a second outward position, and is operable to block movement of the at least one mandrel shoulder and mandrel, at least one locking piston, proximate to the at least one slide-locking dog, movable between a first piston position and a second piston position, which is operable to block movement of the slide-locking dog, a biasing member, proximate to an end of the at least one locking piston, which is operable to move a piston to the second piston position at or below a particular annulus pressure, an actuator coupled to the mandrel, and a valve, coupled to the actuator, where the motion of the mandrel is translated by the actuator to the valve to move the valve between an open configuration and a closed configuration. In aspects, the pressure-dependent locking and valve assembly includes at least one locking piston, where when the locking piston is in the second piston position, the slide-locking dog is blocked from moving to a second outward position. In other aspects, the pressure-dependent locking and valve assembly is operable such that when the slide-locking dog is in the first inward position, the slide-locking dog obstructs the range of motion of the mandrel shoulder and blocks motion of the mandrel. In yet further aspects, the pressure-dependent locking and valve assembly can include a biasing member which is a spring, or a biasing member which is a compressed gas. In other aspects, the pressure-dependent locking and valve assembly can have the first mandrel position and the second mandrel position be at different locations along a longitudinal axis of the tool string. In some aspects, the pressure-dependent locking and valve assembly can have the second mandrel position be rotationally offset from the first mandrel position around a longitudinal axis of the tool string.

In some aspects of the present disclosure, a method of controlling a pressure-dependent locking assembly at annulus pressure is provided. The method of controlling a pressure-dependent locking assembly at annulus pressure can include deploying a tool string having a mandrel, at least one slide-locking dog, at least one locking piston, and at least one biasing member, moving the mandrel such that the at least one slide-locking dog shifts to an inward position that obstructs the range of motion of mandrel shoulders projecting from the mandrel, projecting the at least one locking piston with the biasing member to a piston position that obstructs the at least one slide-locking dog from moving out of the inward position, where the at least one locking piston is projected due to a differential annulus pressure on opposing sides of the locking piston and the biasing member. In aspects, the method can further include providing the tool string with an actuator, and at a depth within the wellbore, mechanically coupling the mandrel with the actuator such that motion of the mandrel within the tool string is translated to the actuator. In other aspects, the method can further include providing the tool string with a valve, where as the tool string is deployed, the valve is in a closed configuration, and moving the mandrel such that the actuator translates the motion of the mandrel to shift the valve to be in an open configuration. In other aspects, the method can further include withdrawing the tool string from the wellbore, where the valve is held in the open configuration as the tool string is withdrawn because the slide-locking dog and mandrel are blocked from moving. In yet further aspects, the method includes providing a tool string having a gas delivery assembly, and delivering gas to the wellbore to change the differential annulus pressure on at least one side of the locking piston. In some aspects, the method can include mechanically coupling the mandrel with the actuator via an operating connector engaged to the mandrel with locking dogs.

The foregoing description of the disclosure, including illustrated aspects and examples has been presented only for the purpose of illustration and description and is not intended to be exhaustive or to limit the disclosure to the precise forms disclosed. Numerous modifications, adaptations, and uses thereof will be apparent to those skilled in the art without departing from the scope of this disclosure. Aspects and features from each example disclosed can be combined with any other example.

What is claimed is:

1. A pressure-dependent locking assembly comprising:

a mandrel movable between a first mandrel position and a second mandrel position within a tool string, where the body of the mandrel includes at least one mandrel shoulder;

at least two slide-locking dogs, each proximate to at least one mandrel shoulder, each movable laterally between a first inward position and a second outward position, and each operable to block movement of the mandrel;

at least two locking pistons, each proximate to one of the at least two slide-locking dogs, each movable between a first piston position and a second piston position, and each operable to block movement of a respective slide-locking dog in the second piston position; and at least two biasing members, each proximate to an end of one of the at least two locking pistons, and each operable to move a respective locking piston to the second piston position, that operates to move the locking piston to the second position at or below a particular annulus pressure formed between a wellbore and the tool string.

2. The pressure-dependent locking assembly of claim 1, wherein when at least one of the at least two locking pistons is in the second piston position, the respective slide-locking dog is blocked from moving to the second outward position.

3. The pressure-dependent locking assembly of claim 1, wherein when any one of the slide-locking dogs is in the first inward position, the slide-locking dog obstructs a range of motion of the mandrel shoulder and blocks motion of the mandrel.

4. The pressure-dependent locking assembly of claim 1, wherein at least one of the biasing members is a coil spring.

5. The pressure-dependent locking assembly of claim 1, wherein at least one the biasing members is a compressed gas.

6. The pressure-dependent locking assembly of claim 1, wherein the first mandrel position and the second mandrel position are different locations along a longitudinal axis of the tool string.

7. The pressure-dependent locking assembly of claim 1, wherein the second mandrel position is rotationally offset from the first mandrel position around a longitudinal axis of the tool string.

8. A pressure-dependent locking and valve assembly comprising:

a mandrel movable between a first mandrel position and a second mandrel position within a tool string, where the body of the mandrel includes at least one mandrel shoulder;

at least two slide-locking dogs, proximate to the at least one mandrel shoulder, each movable laterally between a first inward position and a second outward position, and each operable to block movement of the at least one mandrel shoulder and mandrel;

at least two locking pistons, each proximate to one of the slide-locking dogs, each movable between a first piston position and a second piston position, and each operable to block movement of one of the two slide-locking dogs in the second piston position;

wherein a biasing member is proximate to an end of each one of the locking pistons, and each biasing member is operable to move the respective locking piston to the second piston position at or below a particular annulus pressure formed between a wellbore and the tool string;

a gas delivery assembly, located below the at least one mandrel shoulder, operable to provide gas to the wellbore to change an annulus pressure;

an actuator coupled to the mandrel;

and a valve, coupled to the actuator, where the motion of the mandrel is translated by the actuator to the valve to move the valve between an open configuration and a closed configuration.

9. The pressure-dependent locking and valve assembly of claim 8, wherein when at least one of the at least two locking pistons is in the second piston position, the respective slide-locking dog is blocked from moving to the second outward position.

10. The pressure-dependent locking and valve assembly of claim 8, wherein when any one of the slide-locking dogs is in the first inward position, the slide-locking dog obstructs a range of motion of the mandrel shoulder and blocks motion of the mandrel.

11. The pressure-dependent locking and valve assembly of claim 8, wherein at least one of the biasing members is a coil spring.

12. The pressure-dependent locking and valve assembly of claim 8, wherein at least one of the biasing members is a compressed gas.

13. The pressure-dependent locking and valve assembly of claim 8, wherein the first mandrel position and the second mandrel position are different locations along a longitudinal axis of the tool string.

14. The pressure-dependent locking and valve assembly of claim 8, wherein the second mandrel position is rotationally offset from the first mandrel position around a longitudinal axis of the tool string.

15. A method of controlling a pressure-dependent locking assembly at annulus pressure comprising:

deploying a tool string having a mandrel, at least two slide-locking dogs, at least two locking pistons, and at least two biasing members;

delivering gas with a gas delivery assembly to a wellbore to change the differential annulus pressure on a downhole side of the at least two locking pistons;

moving the mandrel such that the at least two slide-locking dogs both shift to an inward position that obstructs the range of motion of mandrel shoulders projecting from the mandrel; and projecting each of the at least two locking pistons with one of the at least two biasing members to a piston position that obstructs either of the at least two slide-locking dogs from moving out of the inward position, where the at least one locking piston is projected due to a differential annulus pressure on opposing sides of the locking piston and the biasing member.

16. The method of claim 15, further comprising:

the tool string further including an actuator; and at a depth within the wellbore, mechanically coupling the mandrel with the actuator such that motion of the mandrel within the tool string is translated to the actuator.

17. The method of claim 16, further comprising:

the tool string further including a valve, wherein as the tool string is deployed, the valve is in a closed configuration; and moving the mandrel such that the actuator translates the motion of the mandrel to shift the valve to be in an open configuration.

18. The method of claim 17, further comprising withdrawing the tool string from the wellbore, where the valve is held in the open configuration due to the slide-locking dog and mandrel being blocked from moving.

19. The method of claim 15, wherein the gas delivered is nitrogen.

20. The method of claim 16, further comprising mechanically coupling the mandrel with the actuator via an operating connector engaged to the mandrel with locking dogs.

* * * * *